United States Patent [19]

Galer

[11] 4,126,246

[45] * Nov. 21, 1978

[54] PLASTIC LIDS AND PAILS

[75] Inventor: Herbert W. Galer, Pine Township, Allegheny County, Pa.

[73] Assignee: United States Steel Corporation, Pittsburgh, Pa.

[ * ] Notice: The portion of the term of this patent subsequent to Jul. 12, 1994, has been disclaimed.

[21] Appl. No.: 784,494

[22] Filed: Apr. 4, 1977

Related U.S. Application Data

[63] Continuation of Ser. No. 758,379, Jan. 5, 1977, and a continuation-in-part of Ser. No. 563,262, Feb. 28, 1978, Pat. No. 4,034,886, and a continuation-in-part of Ser. No. 563,272, Mar. 28, 1975, Pat. No. 3,998,355, and a continuation-in-part of Ser. No. 564,944, Apr. 3, 1975, Pat. No. 4,014,452.

[51] Int. Cl.[2] ..... B65D 7/44

[52] U.S. Cl. ..... 220/304; 206/586

[58] Field of Search ..... 200/72, 74, 288, 304, 200/83, 306; 206/508, 521, 586

[56] References Cited

U.S. PATENT DOCUMENTS

| | | | |
|---|---|---|---|
| 3,049,260 | 8/1962 | Stone | 217/53 |
| 3,128,903 | 4/1964 | Crisci | 220/306 |
| 3,216,148 | 11/1965 | Amberg | 220/306 |
| 3,510,023 | 5/1970 | Ullman et al. | 150/0.5 |
| 3,836,043 | 3/1974 | Levin | 220/851 C |

*Primary Examiner*—William Price
*Assistant Examiner*—Joseph Man-Fu Moy
*Attorney, Agent, or Firm*—Frank Madonia

[57] ABSTRACT

This invention concerns plastic lids and pails having improved resistance to leakage upon impact. Upstanding elements dissipate impact forces from the assembled pail and lid.

3 Claims, 8 Drawing Figures

PLASTIC LIDS AND PAILS

This is a continuation of application Ser. No. 758,379, filed Jan. 5, 1977c.i.p. of application Ser. No. 563,262, filed Feb. 28, 1978 , now U.S. Pat. No. 4,034,886; c.i.p. application Ser. No. 562,272, filed Mar. 28, 1975, now Pat. No. 3,398,355; c.i.p. of application Ser. . 564,944, now U.S. Pat. No. 4,814,592.

BACKGROUND OF THE INVENTION

Large thick-walled plastic containers are used for packaging and transporting materials in the form of liquids and solids. These materials may be solids, liquids or pastes, aqueous or organic, acidic or alkaline, e.g., detergent solutions, latices, foods or condiments, fine chemicals, etc. Three and one-half, five- and six-gallon sizes are most common. Because of inertness and toughness, plastics such as high density polyethylene or other inert moldable thermoplastic resins are preferred materials. The containers are filled with the contents, capped, perhaps stored, and shipped. After they are transported to the user, he may also store them. In storage, these containers are stacked one upon the other. After being opened, they may be reopened and closed as the contents are used. There are two common types of container constructions: the wide mouth or open-head pail and the closed mouth or tight-head pail. This invention relates to constructions for open-head pails so that they may have the structural characteristics associated with tight-head pails yet remain the wide mouth access of the open-head pails.

SUMMARY OF THE INVENTION

In this invention, there is an improved lid construction for resisting impact deflection of the sealed joint when closed pails are subjected to forces at their corners. This is obtained by having thin plastic sections extend up from the surface of the lid in the regions of the corner of the lid so that the impact forces are dissipated. In addition, stackability is enhanced by combining these sections with a groove and handle to provide a secure platform for receiving a container bottom. These features are also applied to lids having screw threads as enagement means between the lid and the pail and to pails having reinforced top portions.

BRIEF DESCRIPTION OF THE DRAWINGS

The features of the invention are illustrated in FIGS. 1–4.

DETAILED DESCRIPTION OF THE INVENTION

Plastic containers constructed in accordance with this invention comprise a pail or receptacle body, a gasket and a lid. The lid is securely fastened to the pail, while the gasket forms the seal between the lid and the pail. The pail will have an opening at its top substantially the width of the pail, a fastening mechanism will be located at or near the top of the pail. The lid will cover the open top of the pail and will have a fastening mechanism about its periphery to cooperate with the mechanism on the pail for securing the lid to the pail.

Figure 1A:
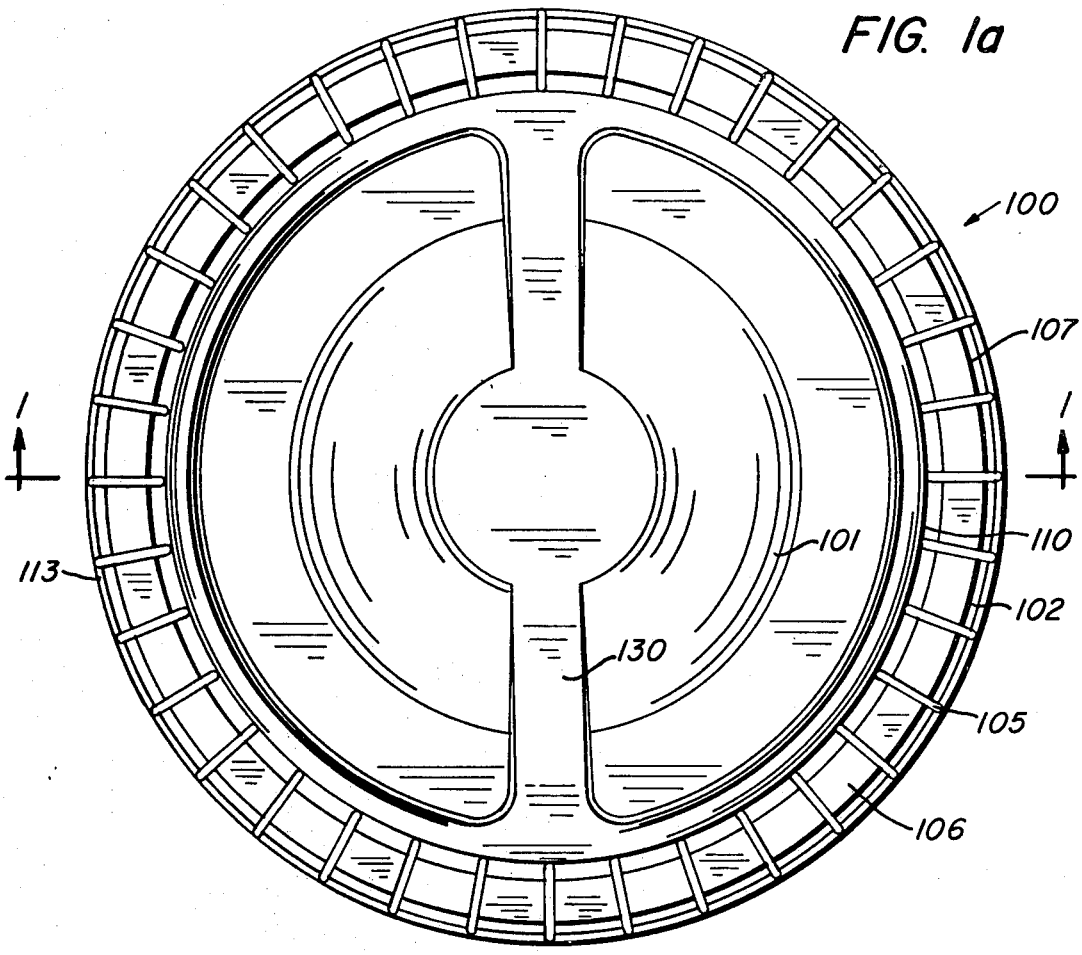
FIG. 1*a* is a plan view of the lid shown in FIG. 1.
Figure 1:
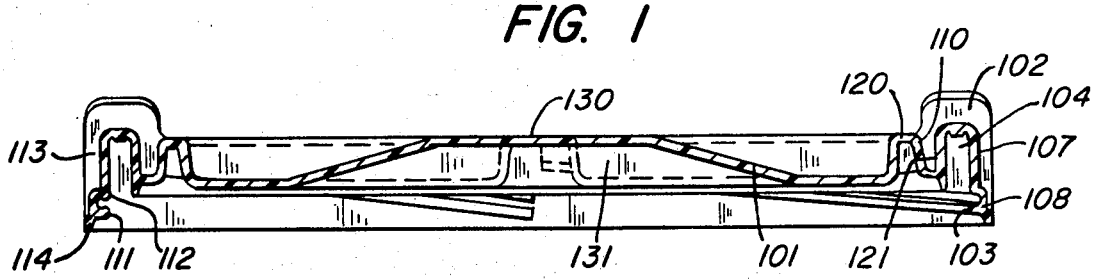
FIG. 1 is a cross section in elevation of a lid according to this invention.
Figure 1B:
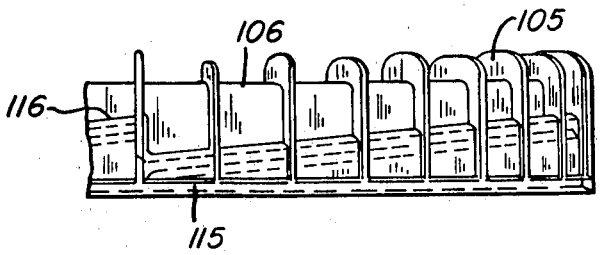
FIG. 1*b* is an elevation in full of a quarter section of the lid shown in FIG. 1.

The lid structures are illustrated in FIGS. 1, 1*a* and 1*b*. The plastic lid 100 has a central closing portion 101. An inverted U-shaped rim 102 surrounds the central closing portion 101. The rim 102 contains the engagement means for fastening the lid to an open-head pail. The interior of the rim is shaped to include spacing for a gasket 300 to be fitted between the lid and the pail. Projecting from the rim are a plurality of thin plastic members 105. These members are located on the periphery of the rim and extend both from the outer wall 107 of the outer leg of the arch in the region of the arch and upwardly above wall 106 forming the top of the arch of the inverted U. By this arrangement, the thin, elongated plastic members are in a position to initially absorb and dissipate impact forces directed to the rim of the lid. This distributes the shock of such impact over a broad region of the lid and causes a reduction in the intensity of force per unit so that the seal formed by the combination of lid, gasket and pail will be able to maintain its integrity after such shocks. The thinness and spacing of the upstanding members is selected according to the mass of the container and the curvature of the rim. These members are thin enough and long enough so that upon impact they deflect rather than rigidly transmit the forces to the rim proper.

In cross section, the thin elongated members are solid. The member can have a uniform thickness. As the spacing between the members is increased, this will allow deflection at the intersection with the top surface of the lid. In such cases, it is desirable to have a reinforced section adjacent the intersection so that it will prevent cracking and penetration of the cracking of the thin member into the interior of the rim where the gasket and pail are held in a compression seal. By such reinforcement, cracking can be prevented and if cracking does occur, the location of the cracked surface can be controlled so that it is substantially away from the top surface and the integrity of the seal is not impaired. One form of the reinforcement is to have the lower section of the thin member with a greater thickness than the upper section. The thicker section may extend for up to about one-half of the total length of the member above the top surface of the lid. In another form, a narrow annular section can extend above the rim of the lid, the thin upstanding members intersect approximately radially with the annular section. The annular section will stiffen the region of the upstanding members adjacent the outer wall of the lid which prevents penetration of a crack into the sidewall of the lid while the upstanding members absorb and dissipate impact forces.

A standard test for tight-head pails, the D.O.T. four-foot drop test, can be used to good advantage for observing the benefits of this invention. In both versions of the test, the assembly of pail and lid is dropped from a height of four feet onto a floor. On one version, the direction is such that the corner of the lid strikes the floor at an angle of 45°. In the other version, the directin is such that the axis through the center of the pail is parallel to the floor. Usually, the container is filled with water. At the time of impact, noticeable deflection occurs in the conventional lids with open-head pails that causes the circular shape to become wrinkled. In the pail, there is also a noticeable deflection or kink at the top section. Furthermore, leakage from the assembly is shown by spillage of liquid. By using this invention, the deflection of both the lid and the pail can be controlled as well as avoidance of leakage. By having the members extend from the lower edge 108 of the outside wall of the rim, complete protection is afforded against incident impact forces.

A particularly advantageous construction results when the upstanding members 105 of the lid are combined with a second inverted U-shaped portion 120 adjacent to the rim of the lid. This second portion 120 extends above the central closing portion and ends below the outer wall 106 forming the top of the inverted U section of the rim. The upstanding members together with the second U-shaped portion form a receptacle for receiving the bottom section 230 of a pail 200, the bottom being shown in phantom outline in the partial cross section of the lid in FIG. 3. With this construction, several closed pails can be assembled on top of each other. The lower pail will securely hold the next adjacent upper pail and the inverted U-shaped portion of the lid can withstand heavy loads without deflection of the lid. By having the upstanding members 105 formed integral with the outer wall 110 of the inner leg of the rim and the outer leg of the second inverted U-shaped portion, the resulting lid structure tends to act as a unit in dissipation of impact forces on the rim and the resistance to vertical loads.

The lids are fastened to the pails with engagement means in the outer leg 113 of the inverted U-shape of the rim. These are adapted to mate with corresponding devices on the pail. In one form the engagment means may be screw threads 111, 112. Those shown in FIG. 1 have a generally buttress form and a long pitch and each thread extends about one-quarter of the circumference of the lid. This gives a large mechanical advantage (9/1 or greater); the lid can easily be engaged or disengaged with high compression on the gasket. Another form of engagement means is a peripheral bead extending inwardly from the inner wall of the outer leg of the inverted U in the rim. With the upstanding members of the lid, the seal between lid, gasket and pail is protected. The threads may be disposed with one of a full section 111 and one with a half section 112 as the next adjacent thread face. Inasmuch as the lids are made by injection molding, a preferred form of lid having screw threads for engagement also has the outer wall 113 of the inverted U in the rim 115, 116 contoured to follow in parallel the upwardly rising threads 113 as shown in FIG. 1*b*. This simplifies the manufacturing techniques and allows a uniform wall thickness over the whole cross section of the lid. Furthermore, when polyethylene or a similar resin with high slippage is the material of construction, the lids having screw threads should also have a secondary locking device so that vibration during transportation does not cause the lid and pail to loosen by slippage. One such device is notches 114 formed in the lower edge of the outer wall of the lid for locking onto short posts or bars 214 on the pail. When the lid is in its tightly closed position on the pail, the bar or posts will be just tall enough to penetrate and engage the notches for a completely secure container. Rather than mechanical structures such as notches, light coating of adhesive will secure the lid against vibration during shipment. The lid may also be disengaged by hammer blows.

An integrally formed handle in the central closing portion of the lid may be in the form of a hollow bar 130 rising above and across the central closing portion. The sidewalls 131 of the bar present large flat vertical areas for closing or opening the container. In closing, automatic cappers having rotating grippers or bars can bear on the flat surfaces of the handle and quickly close the lid. In opening, automatic machinery or simple tools such as hammers can be used to overcome the locked notch and post and then unspin the lid. By having lids with the screw threads, the containers may be opened without the use of pry bars, knives, etc., to cut away portions of the lid and may readily be reclosed and reopened.

Figure 2:
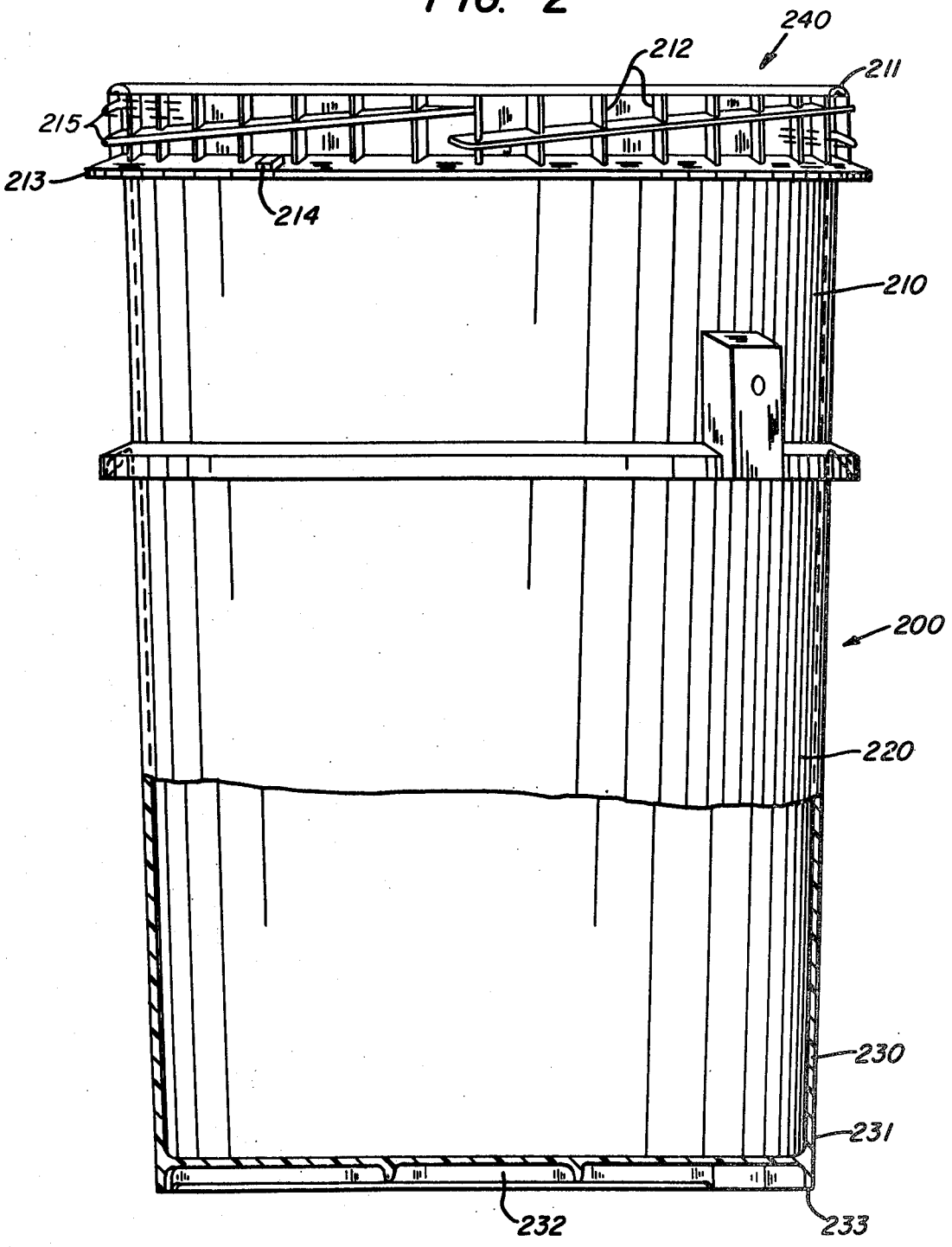
FIG. 2 is an elevation, partly in cross section, of a plastic pail according to this invention.

The plastic pail structures of particular interest are those having a wide-mouth opening, open-head pails. As shown in FIG. 2, the pail 200 has a topmost section 210, an intermediate section 220 and a bottom section 230. The topmost section has the matching engagement means for the lid located at the mouth of the pail.

Figure 3:
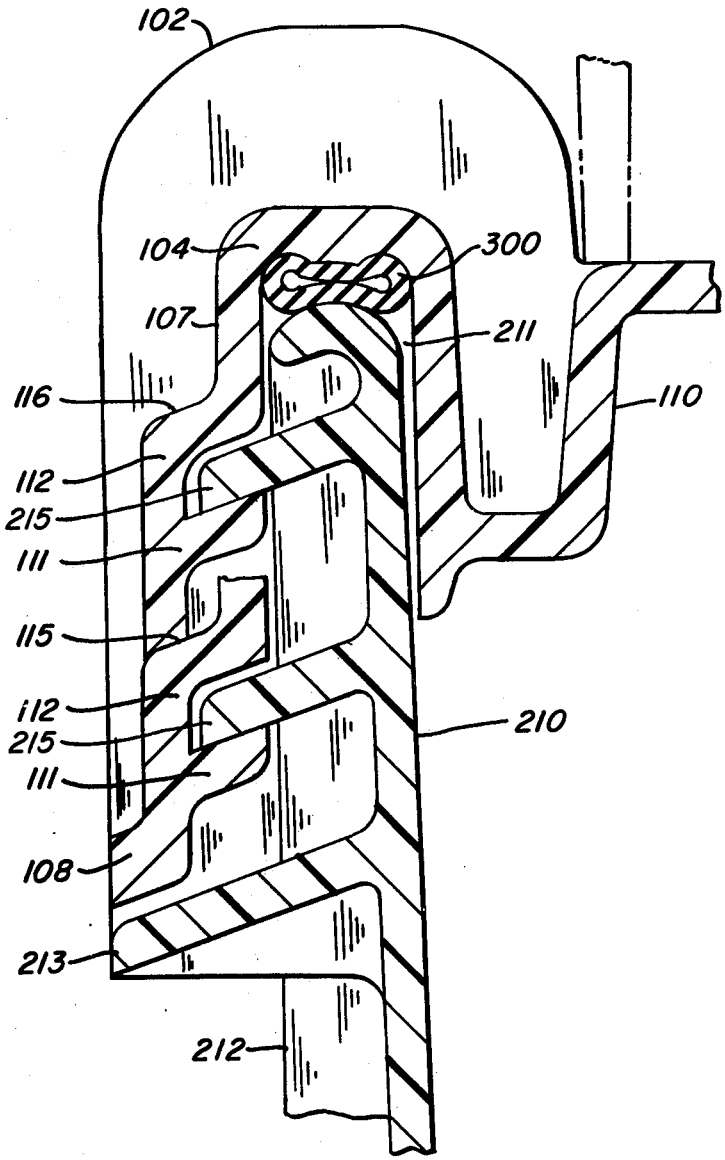
FIG. 3 is an elevation of an enlarged cross section showing the lid of FIG. 1 combined with the pail of FIG. 2.

Reinforcing members 212 in the form of thin integrally molded elements extending outwardly from the outer sidewall of the pail to the mid region of the engagement means and extending through the vertical segment of the topmost section can be used with engagement means both in the form of screw threads and snap fit beads. These members 212 tend to stiffen the topmost section of the pail against deflection and from impact forces and transfer or distribute such deflection to the intermediate section. When used with screw threads, it is preferred that the reinforcement members extend into the screw thread a distance sufficient to reduce deflection of the individual thread. As shown in FIG. 3, the reinforcing members form a girder-work projecting radially to about midway of the thread. This increases the stiffness of the free end of the thread. The thread can extend outwardly of the rim 211 of the pail. As a consequence, the interior of the arch in the lid and the arrangement of the top section of the pail can be dimensioned so that the engagement means of the lid and the pail are mated at a position that is exterior of the rim 211 of the pail. Thus the lateral dimensions for the engagement means can be independent of the lateral dimension of the interior of the U-shaped arch in the lid and the pail which hold the compression on the gasket. The result is a wider manufacturing tolerance in the dimension of the molded plastic parts while the mating engagement parts can be securely fastened.

The reinforcing members on the pail may be oriented in the direction of draw of the mold which forms the pail. Then, these members will form an acute angle with a radius through the axis of the pail which passes through the intersection of the pail and the members. The members are arranged to form a stiff reinforcing action in the topmost section of the pail without a substantial mass of resin being present. A preferred assembly is for vertical members to extend down from the top of the pail to a peripheral shoulder 213 extending outwardly from the pail. The threaded engagement means will be disposed as a helix upwardly along the pail axis and will extend from the top of the pail to the peripheral shoulder. The reinforcing elements may have a uniform thickness or may be thicker in the portion above the thread and thinner below the thread.

The bottom section 230 of the pail has a vertical sidewall section 231 and a horizontal bottom wall section 232 which is disposed above the lower edge 233 of the sidewall section 231. The lower edge 233 of the sidewall section is shaped to repose within the peripheral rim of a lid similar to that described above. The stacking feature of the lid and pail combination is illustrated in FIG. 3 with the adjacent pail bottom shown in phantom outline.

An illustrative example of a specific container having a capacity of 6 gallons and constructed according to this invention with the configuration shown in FIGS. 1–3 would have the following representative dimensions, the Figures themselves being approximately to scale. High density polyethylene would be injection molded to form the lid 100 and the pail 200. The lid has an overall diameter of 12.5 inches, the central closing portion is 9.38 inches in diameter. The inverted U-shaped rim has an interior span of 0.624 inch. The thread depth is 0.175 inch. The span between the outer wall of the inner leg of the U-shaped rim and the wall of the adjacent wall of the inverted U-shaped portion is 0.275 inch. The entire span of the U-shaped portion is 0.70 inch. The typical wall thickness for the lid is 0.10 inch.

The upstanding members 105 may be spaced at 10° intervals, they are 0.07 inches thick. The overall height of the member is 1.175 inches.

The inverted U-shaped rim is about 1.575 inches high, while adjacent inverted U-shaped portion is 0.70 inch. As shown the adjacent U-shaped portion is elevated from the mid-point of the rim. The thread shown is 0.100 inches thick and rises 0.50 inches in each arcuate segment. The handle portion is about 0.60 inches high.

The pail is 17.5 inches high overall with an average wall thickness of 0.10 inches. The topmost section would be 6.225 inches from the rim to the circumferential shoulder section bearing the handle. The intermediate section is about 11.5 inches and the bottommost section is about 0.75 inches. In the bottommost section, the outer walls extend about 0.4 inches below the floor of the pail.

The top of the pail is 11.8 inches in diameter. The rim diameter of the top is 11.5 inches. The rim has a radius of 0.156 inches. The screw threads are 0.10 inches thick and extend 0.79 inches from the side wall. These threads are disposed to match those on the lid. There is a taper in the width of the pail so that it is 10.5 inches in diameter at its bottom.

The reinforcing members 212 project about 0.55 inches from the side wall and extend down from the rim for about 1.125 inches. These are oriented at a slight angle to the surface of the side wall so that when the pail is molded, segmented mold parts can move radially away from the pail. These members are 0.05 inches thick and there are 36 in number, spaced about the circumference of the pail. On the shoulder 213, small posts extend upwardly about 0.1 inch. These are to engage the notches which are found in the bottom of the rim on the lid. In the arch of the lid, space is provided between the compression member 104 and the rim of the pail to allow for the compressed gasket. The compression member causes the gasket to initially squeeze when the lid is first fitted to the pail. The further engaging of the lid and the pail results in a fully compressed gasket which forms an especially effective seal.

Figure 4A:
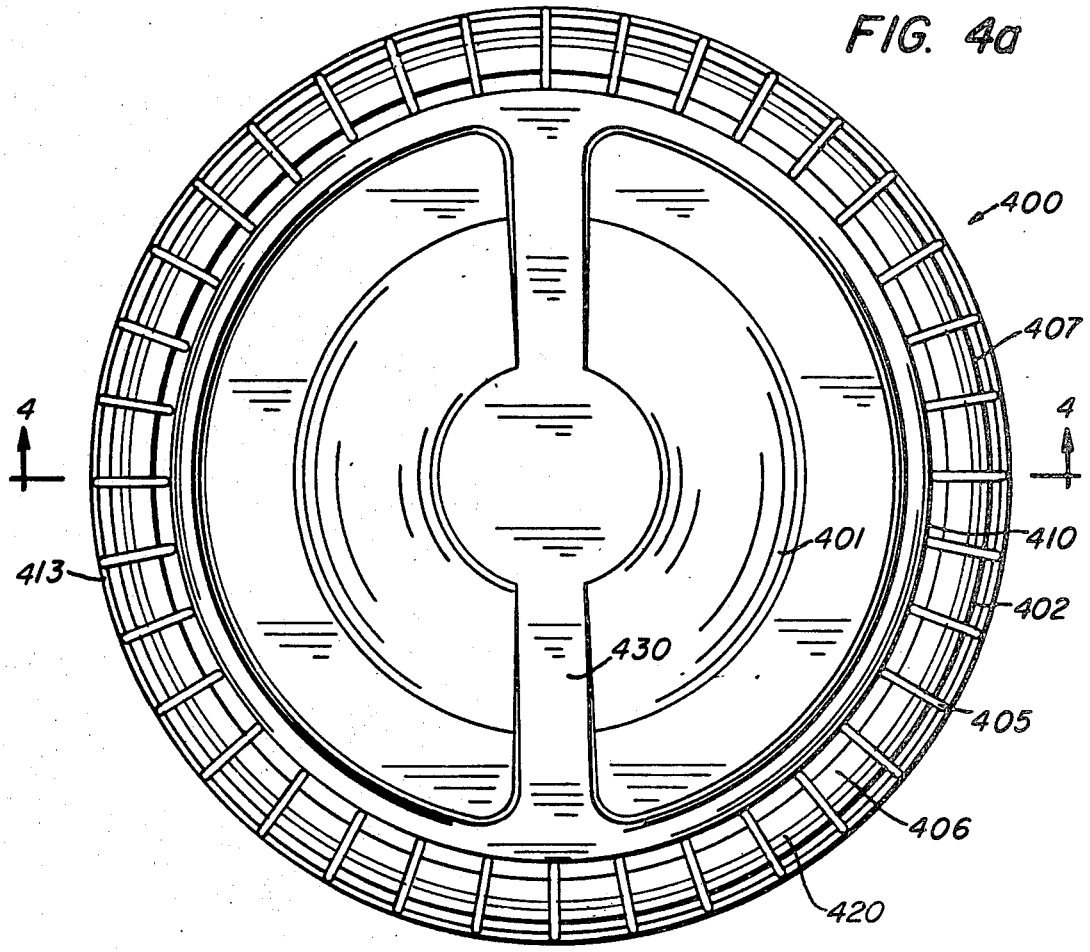
FIG. 4*a* is a plan view of the lid shown in FIG. 4.
Figure 4:
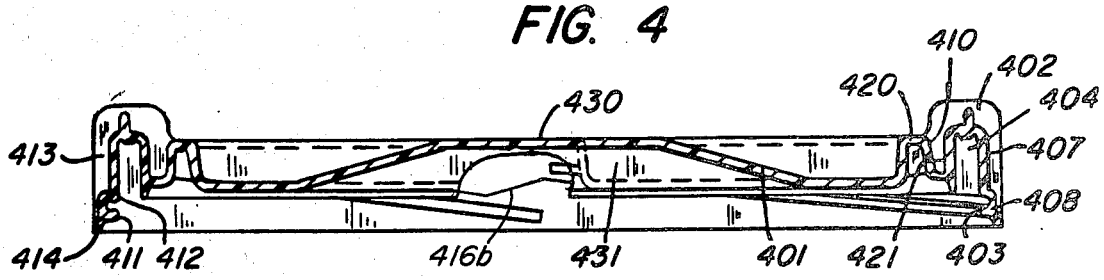
FIG. 4 is a cross section in elevatin of a lid embodying an alternative structure according to this invention.
Figure 4B:
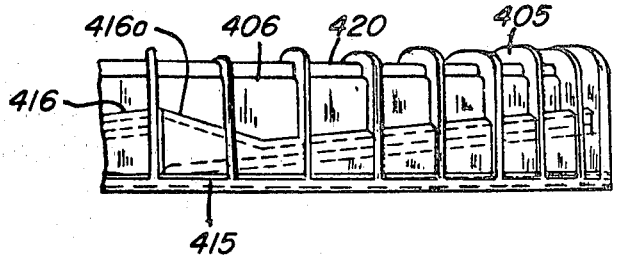
FIG. 4*b* is an elevation in full of a quarter section of the lid shown in FIG. 4.

In the structures shown in FIG. 4, 4*a* and 4*b*, the lid structure shown is generally similar to that shown in FIGS. 1–3, corresponding numerals have been used to show similar parts. The dimension of these parts and their functions have been explained previously in connection with FIGS. 1–3. The reinforcement member 420 is shown as an annular element upstanding from the arch of the lid 400. Reinforcement member 420 is approximately 0.062 inches thick and extends 0.220 inches above the arch. The outside of the reinforcing member is disposed 0.062 inches from the outside wall 107 of the lid. In the event that the thin upstanding members crack, the breakage is confined to the outwardly and upwardly extending regions of the members so that the integrity of the seal is not impaired. Also shown in FIGS. 4*a* and 4*b* is an inclined section 416*a*, 416*b* between adjacent uppermost threads 112. This inclined section has the advantage of facilitating engagement of pail, lid and gasket by acting as a guide for the leading edge of the threads. When lid, gasket and pail are placed in initial assembly, the lid is rotated and will align its threads by the guide action of the inclined section. The rotating lid will move away from the pail as the leading edge of the thread bears against the surface inside 416*b* of the inclined section. This results in a sure trapping action of the thread on the pail with the thread on the lid so that the lid can be assembled with the pail.

It has been found that when the assembled lid and container are subjected to impact force, e.g., by being dropped to land on its corner, there is a further tightening of lid and pail. In the event it is desired to quickly loosen the threaded engagement, slots can be provided in the lid so that implements such as screwdrivers can be used to make an initial separation between the lid and the pail. As an alternative, by deliberately applying a separate impact force to the assembled lid and pail, the seal between them can be further improved.

it is contemplated that the lid may contain smaller pour openings as part of its structure. In this manner, the open-head pail structure can be used with the small pour opening fittings common for tight-head pails.

The common capacity for the pails of this invention are 3.5, 5 and 6 gallons. Other sizes can be made utilizing the advantages of this invention. As well, variations in the size and shape of the parts of the lid and the pail can be made. These and other changes such as materials of construction as would be apparent to those versed in this field are within the invention set forth in the following claims.

I claim:

1. In the combination of a stiff molded plastic lid, a compressible gasket and an open-head pail, said lid having a central closing portion and an inverted U-shaped rim, the outer wall of said rim including means for engagement with said open-head pail and the interior of said rim being dimensioned to receive said compressible gasket, said means for engagement being disposed to effect a seal by compression of said gasket between the upper rim of said pail and the interior of the inverted U-shaped rim in said lid, said pail having engagement means in its upper section mated with those of said lid, said combination being assembled to effect a tight seal by compression of said gasket between the upper rim of said pail and the interior of the inverted U-shaped rim in said lid, the improvement comprising an inverted U-shaped portion adjacent to said rim, said portion extending above the central closing portion and ending below the outer wall forming the arch of said rim, said inverted portion forming a support for a pail when said pail is positioned on said lid, and a plurality of thin upstanding members radially disposed about the periphery of said rim and extending upwardly above the wall forming the arch of said inverted U and outwardly from the outer wall of the rim in the region of said arch, said members having a length to thickness ratio sufficient to allow deflection of said members without substantial deflection of said rim, the number and spacing of said members being sufficient to position them close enough to each other relative to the curvature of said rim so that impact forces directed to said rim are absorbed and dissipated by said members to reduce substantially the intensity of force per unit area transmitted to the seal through said rim.

2. The lid of claim 1 having the upstanding members formed integral with the outer wall of the inner leg of said rim and the outer wall of the outer leg of said inverted U-shaped portion.

3. The lid of claim 2 wherein said upstanding members and said inverted U-shaped portion cooperate to engage the bottom and lower wall of a pail positioned in said lid.

* * * * *

UNITED STATES PATENT AND TRADEMARK OFFICE

CERTIFICATE OF CORRECTION

PATENT NO. : 4,126,246

DATED : November 21, 1978

INVENTOR(S) : Herbert W. Galer

It is certified that error appears in the above-identified patent and that said Letters Patent are hereby corrected as shown below:

On the cover page under "Related U. S. Application Data", line 2, change "Feb. 28, 1978" to -- March 28, 1975 --.

Column 1, line 3, after "1977" insert a semicolon -- ; --;

line 4, change "Feb. 28, 1978" to -- March 28, 1975 --;

line 5, change "562,272" to -- 563,272 --;

line 6, change "3,398,355" to -- 3,998,355 --;

same line, after "Ser." insert -- No. --;

line 7, change "4,814,592" to -- 4,014,452 --;

line 32, change "remain" to -- retain --;

line 64, change "elevatin" to -- elevation --.

UNITED STATES PATENT AND TRADEMARK OFFICE

CERTIFICATE OF CORRECTION

PATENT NO. : 4,126,246

DATED : November 21, 1978

INVENTOR(S) : Herbert W. Galer

It is certified that error appears in the above-identified patent and that said Letters Patent are hereby corrected as shown below:

Column 4, line 54, change "dimension" to -- dimensions --.

Column 5, line 47, change "11.5" to -- 11.25 --.

Column 6, line 40, change "it" to -- It --.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*